US012553663B2

(12) United States Patent
Son

(10) Patent No.: US 12,553,663 B2
(45) Date of Patent: Feb. 17, 2026

(54) REFRIGERATOR AND HOME APPLIANCE

(71) Applicant: LG Electronics Inc., Seoul (KR)

(72) Inventor: Younghun Son, Seoul (KR)

(73) Assignee: LG Electronics Inc., Seoul (KR)

( * ) Notice: Subject to any disclaimer, the term of this patent is extended or adjusted under 35 U.S.C. 154(b) by 137 days.

(21) Appl. No.: 18/379,513

(22) Filed: Oct. 12, 2023

(65) Prior Publication Data

US 2024/0210102 A1 Jun. 27, 2024

(30) Foreign Application Priority Data

Dec. 26, 2022 (KR) ..... 10-2022-0184637

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01); *F25D 2400/18* (2013.01); *F25D 2400/361* (2013.01)

(58) Field of Classification Search
CPC ..... F25D 29/00; F25D 29/005; F25D 23/028; F25D 2400/361
See application file for complete search history.

(56) References Cited

U.S. PATENT DOCUMENTS 8,485,617 B2 * 7/2013 Park ..... F25D 23/028 312/405.1
8,567,885 B2 * 10/2013 Lee ..... E05D 7/0027 312/405
8,960,934 B2 * 2/2015 Sung ..... F25D 23/028 362/218
2012/0260683 A1 * 10/2012 Cheon ..... F25D 29/00 62/125
2016/0334158 A1 * 11/2016 Joo ..... F25D 23/028
2017/0059875 A1 * 3/2017 Seung ..... G02B 27/144
2017/0188721 A1 * 7/2017 Park ..... F21V 15/01
2021/0095913 A1 * 4/2021 Kim ..... F25D 23/02
2021/0131720 A1 * 5/2021 Chu ..... F25D 23/028
2021/0254888 A1 * 8/2021 Cremaschi ..... G06Q 30/0268
2021/0325104 A1 * 10/2021 Kang ..... F25D 27/005
2021/0325107 A1 * 10/2021 Kang ..... F25D 23/025
(Continued)

FOREIGN PATENT DOCUMENTS

CN 203731771 U * 7/2014
CN 205014747 U * 2/2016
CN 109028737 A * 12/2018 ..... F25D 23/02
(Continued)

OTHER PUBLICATIONS

Extended European Search Report in European Appln. No. 23210787.0, mailed on Apr. 19, 2024, 8 pages.

*Primary Examiner* — Andrew Roersma
(74) *Attorney, Agent, or Firm* — Fish & Richardson P.C.

(57) ABSTRACT

A home appliance includes a refrigerator. The refrigerator includes a cabinet having a storage space and a door opening and closing the storage space. The door includes: a panel assembly including a front panel forming an outer appearance of the front surface; a door frame connected to the panel assembly; and a touch screen device disposed inside the door frame in contact with the panel assembly, detecting a user's touch operation, and outputting a screen.

19 Claims, 14 Drawing Sheets

(56) References Cited

U.S. PATENT DOCUMENTS

2021/0381751 A1* 12/2021 Park ..... F25D 23/028

FOREIGN PATENT DOCUMENTS

| | | | | |
|---|---|---|---|---|
| DE | 202008017933 | | 12/2010 | |
| ES | 2335170 | B1 * | 5/2011 | ..... F25D 23/02 |
| KR | 101249495 | B1 * | 3/2013 | |
| KR | 10-2017-0082095 | | 7/2017 | |
| KR | 10-2021-0105615 | | 8/2021 | |

* cited by examiner

REFRIGERATOR AND HOME APPLIANCE

CROSS-REFERENCE TO RELATED APPLICATIONS

The present application claims priority under 35 U.S.C. 119 and 35 U.S.C. 365 to Korean Patent Application No. 10-2022-0184637, filed on Dec. 26, 2022, the disclosures of which are hereby incorporated by reference in their entirety.

BACKGROUND

The present disclosure relates to a refrigerator and a home appliance.

In general, a refrigerator is a home appliance that allows food to be stored at low temperatures in a storage space. To this end, refrigerators are designed to keep stored food in optimal condition by cooling the inside of the storage space using cold air generated through heat exchange with the refrigerant circulating in the refrigeration cycle.

Recently, refrigerators are gradually becoming larger and more multi-functional in accordance with changes in eating habits and the trend of higher quality products, and refrigerators equipped with various structures and convenience devices are being released to ensure user convenience and efficient use of internal space.

For example, Korean Patent Publication No. 10-2017-0082095 discloses a refrigerator whose panel assembly selectively becomes transparent according to user manipulation.

Meanwhile, in conventional refrigerators, users can set refrigerator operations by manipulating a touch device provided in the cabinet. In this case, the user has the inconvenience of having to operate the touch device with the door open to set the refrigerator operation.

SUMMARY

An object of this embodiment is to provide a refrigerator and a home appliance equipped with a touch screen device on the front surface of the door that can be operated in a full-touch manner.

An object of this embodiment is to provide a refrigerator and a home appliance equipped with a touch screen device on the door that is easy to assemble and disassemble.

A refrigerator according to an embodiment of the present disclosure includes: a cabinet having a storage space; a door opening and closing the storage space; in which the door includes: a panel assembly including a front panel forming an outer appearance of the front surface; a door frame connected to the panel assembly; and a touch screen device disposed inside the door frame in contact with the panel assembly, detecting a user's touch operation, and outputting a screen.

The door frame may include an upper cap decoration in contact with the rear surface of the front panel, and the touch screen device may be mounted on the upper cap decoration.

The front panel may include: a first portion configured to transmit light and face the touch screen device, and a second portion configured to limit transmission of the light, and in which the upper cap decoration may include: a decoration front surface portion in contact with the front panel and having a cutout at a position corresponding to the first portion, and a decoration lower surface portion recessed downward to provide a mounting space for accommodating the touch screen device.

The touch screen device may include a pressing portion in contact with a rear wall of the mounting space in a state of being accommodated in the mounting space and pressing the touch screen device in the direction of the front panel.

The touch screen device may include: a first case on which a touch module is mounted; a microcomputer controlling the touch module; and a second case coupled to the first case to form a space in which the microcomputer is accommodated.

The pressing portion may have one end connected to one side of the second case and the other end extending rearward and in contact with the rear wall of the mounting space, in a state where the touch screen device is accommodated in the mounting space.

A guide portion protruding toward the front panel at a position corresponding to the pressing portion may be provided on a rear surface of the mounting space.

The touch screen device may includes a boss portion formed so that a fastening member penetrates, the decoration front surface portion is formed with a coupling portion into which the fastening member may be inserted, and the touch screen device may be coupled to the decoration front surface portion.

The first case may include a accommodation groove in which the touch module is mounted, and a circumferential portion protruding in a direction of the front panel along the accommodation groove, and the circumferential portion may be formed with an inclined portion that is inclined as the circumferential portion extends in the direction of the front panel.

The touch module may include a touch portion detecting touch operation; a glass portion disposed in front of the touch portion and in contact with the front panel; a display portion where the screen is output, and the glass portion may be formed to be larger than the touch portion and the display portion.

The first case may include an accommodation groove in which the touch module is mounted, and a circumferential portion protruding in a direction of the front panel along the accommodation groove, and a fixing portion may be formed on the circumferential portion to support the touch portion and one surface of the display portion.

The touch screen device may include a wireless communication module for communication with a remote device.

A wireless communication mounting portion on which the wireless communication module may be mounted is provided on one side of the second case.

The microcomputer may control the display portion to output a screen according to a signal received from the remote device.

The refrigerator may further include a decoration cover covering the open upper surface of the upper cap decoration, in which the decoration cover may be detachably coupled to the upper cap decoration in a state where the touch screen device is accommodated in the mounting space.

According to this embodiment, since the touch screen device is positioned in close contact with the front surface of the door, touch detection accuracy can be prevented from being deteriorated.

According to this embodiment, the touch screen device can be easily replaced when the touch screen device requires service.

DETAILED DESCRIPTION

Hereinafter, specific embodiments of the present disclosure will be described in detail with drawings. However, the present disclosure cannot be said to be limited to the embodiments in which the spirit of the present disclosure is presented, and other degenerative disclosures or other embodiments included in the scope of the present disclosure can be easily suggested by adding, changing, or deleting other components.

Prior to a description, directions are defined. In an embodiment of the present disclosure, a direction toward a door is defined as a front direction with respect to a cabinet illustrated in FIGS. 1, a direction toward the cabinet with respect to the door is defined as a rear direction, a direction toward a bottom on which a refrigerator is installed is defined as a downward direction, and a direction away from the bottom is defined as an upward direction.

Figure 1:
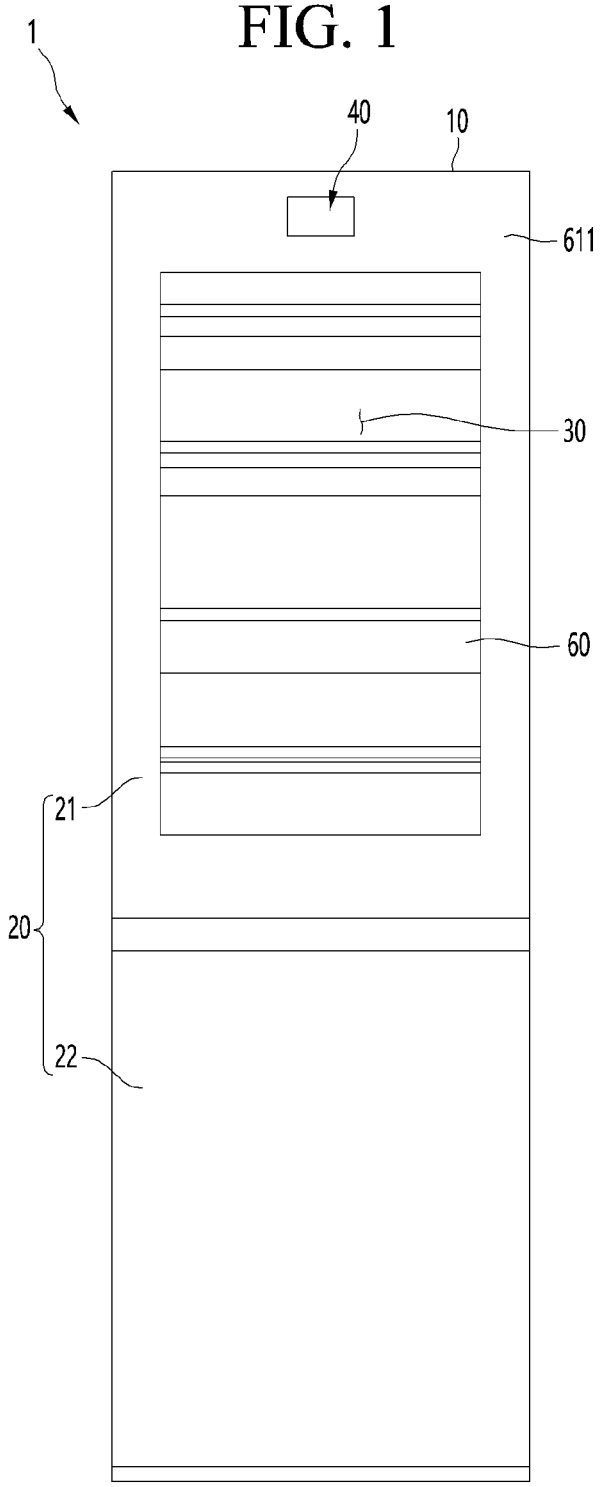
FIG. 1 is a front view illustrating a refrigerator according to an embodiment of the present disclosure.
Figure 2:
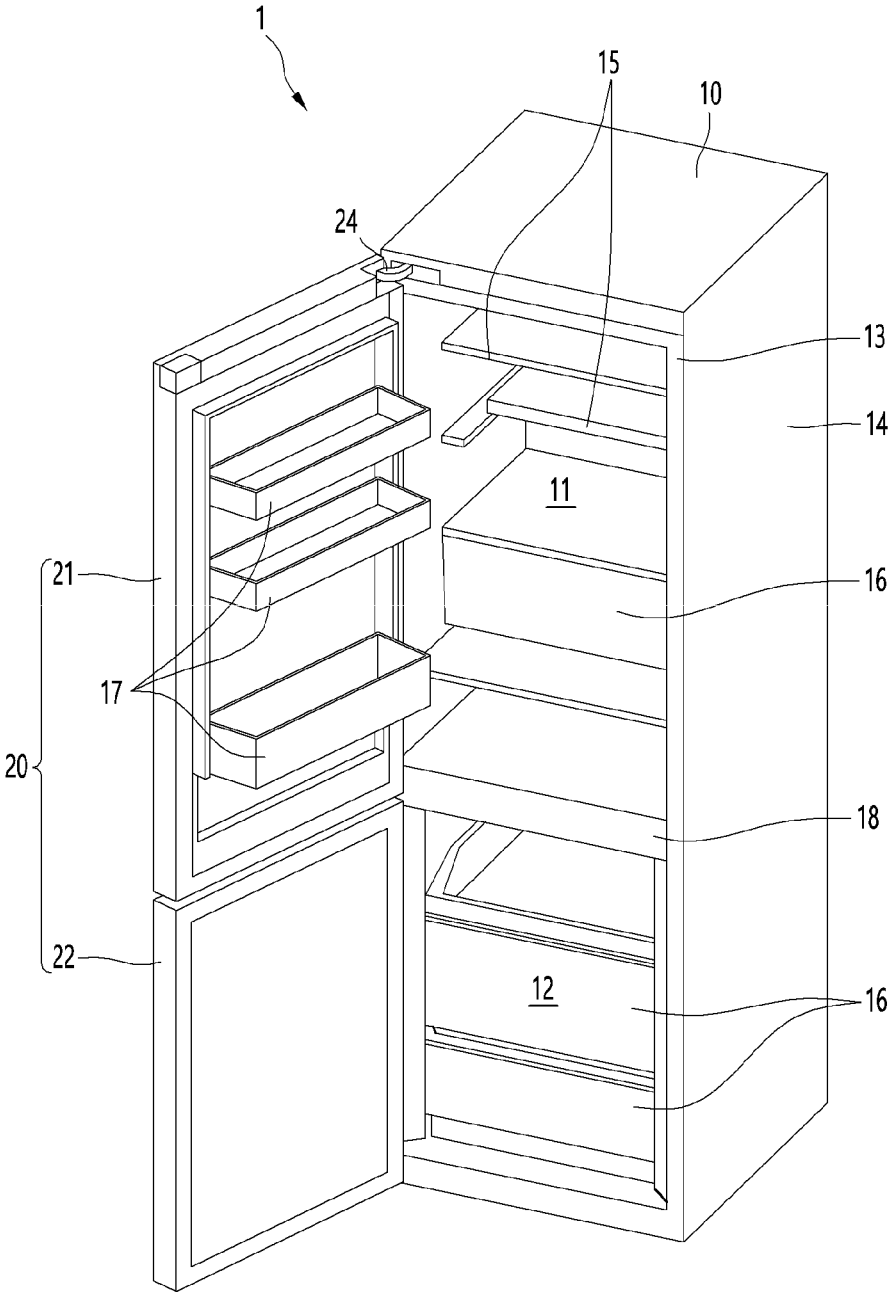
FIG. 2 is a perspective view illustrating a state where the door of the refrigerator is open.

FIG. 1 is a front view illustrating a refrigerator according to an embodiment of the present disclosure, and FIG. 2 is a perspective view illustrating a state where the door of the refrigerator is open.

The refrigerator 1 according to an embodiment of the present disclosure includes a cabinet 10 that forms a storage space, and a door 20 that opens and closes the storage space of the cabinet 10.

The cabinet 10 may include an inner case 13 that forms the wall of the storage space of the refrigerator and an outer case 14 that forms the outer appearance. An insulator may be filled between the inner case 13 and the outer case 14.

The cabinet 10 may be formed with a storage space divided by a barrier 18 in the vertical direction. The upper storage space may be formed with a refrigerating chamber 11, and the lower storage space may be formed with a freezing chamber 12. Of course, a freezing chamber may be formed at the upper portion and a refrigerating chamber may be formed at the lower portion, but it is not limited thereto.

The door 20 may be configured to open and close the upper storage space 11 and the lower storage space 12, respectively. For example, the door 20 may be rotatably mounted on the cabinet 10 using a hinge device 24. Of course, the door 20 may have a structure in which the storage space is opened and closed by introduction and withdrawal.

The upper storage space 11 or the lower storage space 12 may be provided with various storage members such as a shelf 15, a drawer 16, or a basket 17.

If necessary, the storage member may be withdrawn in a state where the upper door 21 and the lower door 22 are opened, and food can be stored by the introduction and withdrawal of the storage member.

A plurality of baskets 17 for storing goods may be provided on the rear surface of the upper door 21 or the lower door 22. The basket 17 may be configured so as not to interfere with storage members provided in the refrigerator in a state where the upper door 21 or the lower door 22 is closed.

Meanwhile, at least a portion of the door 20 may be formed from a transparent material such as glass and may include a see-through portion 30 that can see into the inside of the refrigerator even when the door 20 is closed.

In detail, the door 20 has an opening formed on the front surface, and the see-through portion 30 made of glass can shield the opening.

The glass material constituting the see-through portion 30 can be configured to adjust the light transmittance and reflectance so that the see-through portion can be selectively manipulated into a transparent or opaque state according to the user's manipulation. Therefore, the see-through portion becomes transparent only in the state desired by the user to make the inside of the refrigerator visible, and in other states the see-through portion can remain opaque. For example, when the lighting unit is turned on by the user's manipulation to brighten the inside of the refrigerator, the see-through portion 30 becomes transparent so the storage space can be visualized. Accordingly, the user can check the state of food storage in the storage space without opening the door 20.

In addition, the see-through portion 30 can display the operating state of the refrigerator to the outside by making the display portion disposed behind the door 20 visible through the user's manipulation.

This see-through portion 30 can be provided without limitation on the upper door 21 or the lower door 22, and in this embodiment, the see-through portion 30 is provided on the upper door 21 as an example.

The refrigerator according to the present disclosure is not limited to the form described above, and features of the present disclosure can be applied to all types of refrigerators equipped with doors.

Meanwhile, the refrigerator 1 according to an embodiment of the present disclosure includes a touch screen device 50 capable of being operated by a user's touch. The touch screen device 50 may be detachably mounted on the door 20.

Additionally, the touch screen device 50 can implement a full touch method.

Hereinafter, the structure of the door 20 equipped with the touch screen device 50 will be explained in more detail.

Figure 3:
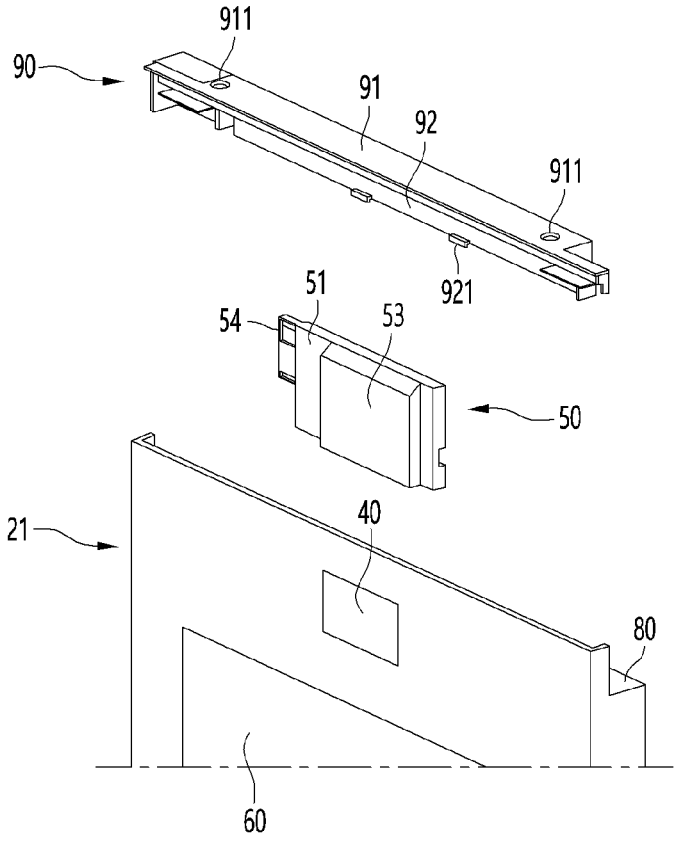
FIG. 3 is a view illustrating a state where the door and the touch screen device are separated, as viewed from the front.
Figure 4:
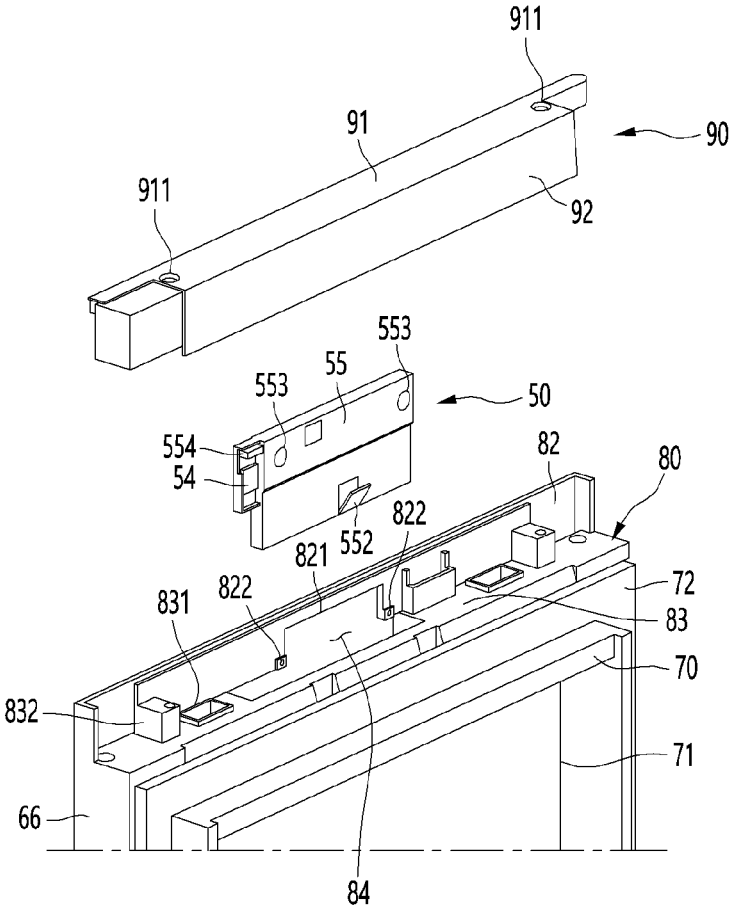
FIG. 4 is a view illustrating a state where the door and the touch screen device are separated, as viewed from the rear.

FIG. 3 is a view illustrating a state where the door and the touch screen device are separated, as viewed from the front, and FIG. 4 is a view illustrating a state where the door and the touch screen device are separated, as viewed from the rear.

The door 20 includes a panel assembly 60 that forms the outer appearance, and a door liner 70 that is mounted spaced apart from the panel assembly 60.

Alternatively, a door body may be provided between the panel assembly 60 and the door liner 70. The front surface of the door body is open so that the panel assembly 60 may be mounted. Additionally, a door liner 70 may be mounted on the rear surface of the door body.

Door 20 includes a door frame that supports panel assembly 60. The door frame may include an upper cap decoration 80 and a lower cap decoration 65 that form the upper and lower surfaces of the door 20. Here, the upper cap decoration may be called the upper frame, and the lower cap decoration can be called the lower frame.

The door 20 may include side decorations 66 that connect the panel assembly 60 and the door liner 70 to form both side surfaces of the door, and the outer appearance may be formed by coupling these components. Here, the side decoration may also be called a side frame.

The inside of the panel assembly 60, the door liner 70, the upper cap decoration 80, and the lower cap decoration 65 may be filled with an insulator 67.

The panel assembly 60 may form the outer appearance of the front surface of the door 20. The interior of the refrigerator can be seen through the panel assembly 60, and the see-through portion 30 may be formed.

The panel assembly 60 includes a front panel 61 forming a front surface. A bezel 611 is formed around the rear surface of the front panel 61, so that components disposed behind the front panel 61 can be hidden from being exposed to the outside. The central area where the bezel 611 is not formed may become the see-through portion 30.

Additionally, a bezel may not be formed on the front panel 61 corresponding to the location where the touch screen device 50 is mounted. The area where the bezel is not formed corresponding to the position where the touch screen device 50 is mounted may be referred to as the display portion 40.

Here, the display portion may be referred to as the first portion. Additionally, the area where the bezel is formed and light transmission is limited may be referred to as the second portion. In addition, the see-through portion 30 may be called a third portion.

The panel assembly 60 may have an outer appearance formed by a rear panel 62 forming the rear surface and an outer frame 64 connecting the front panel 61 and the rear panel 62. The circumference of the front panel 61 may protrude further outward than the rear panel 62.

A touch screen is disposed on the rear surface of the front panel 61 to detect the user's touch operation. In addition, a display is provided behind the front panel 61, and the screen may be output to the see-through portion 30.

The panel assembly 60 is provided with an insulation panel 63 between the front panel 61 and the rear panel 62, so that a multi-layer insulation space can be formed. Rods are provided between the front panel 61, the rear panel 62, and the insulation panel 63, so that the gap between them can be maintained.

With this structure, the panel assembly 60 can see through the inside of the storage space according to user manipulation and can also output a set screen.

Of course, the door 20 may be configured in such a way that an out plate made of stainless steel forms the front surface, and the panel assembly 60 is mounted in an opening provided in the out plate.

The door liner 70 forms the rear surface of the door 20, and a liner opening 71 may be formed in the area where the panel assembly 60 is disposed. Lighting units may be provided on both sides of the liner opening 71 to enable visualization of the space behind the door 20 through the panel assembly 60. Additionally, a gasket 72 is provided on the rear surface of the door liner 70 to prevent cold air from leaking out of the interior space of the cabinet 10 when the door 20 is opened and closed.

The upper cap decoration 80 is coupled to the upper end of the door liner 70 and the panel assembly 60. The upper cap decoration 80 can be mounted on the upper surface of the door body.

At least a portion of the upper cap decoration 80 may be opened to form a decoration opening 81 into which the touch screen device 50 is inserted. The touch screen device 50 may be detachably mounted on the upper cap decoration 80.

The upper cap decoration 80 may include a decoration front surface portion 82 in contact with the rear surface of the panel assembly 60 and a decoration lower surface portion 83 connected between the panel assembly 60 and the door liner 70. Here, the decoration front surface portion 82 may be called the decoration first portion, and the decoration lower surface portion 83 may be called the decoration second portion.

The upper end of the decoration front surface portion 82 may be formed at a position corresponding to the upper end of the front panel 61. A portion of the decoration front surface portion 82 may be cut to provide a cutout 821 so that the touch screen device 50 can be exposed through the display portion 40.

A coupling portion 822 may be provided on the decoration front surface portion 82 to couple the touch screen device 50 and the upper cap decoration 80 through a fastening member S1.

At least a portion of the decoration lower surface portion 83 may be recessed downward to provide a mounting space 84 in which the touch screen device 50 is accommodated.

This mounting space 84 may be provided by the decoration front surface portion 82, the decoration lower surface portion 83, and the rear wall surface 841 of the upper cap decoration 80.

At least a portion of the decoration lower surface portion 83 may be opened to provide an electric wire passage hole 831 that allows electric wires to be introduced and withdrawn into and from the door. Through the electric wire passage hole 831, the main PCB and the panel assembly 60 may be connected with an electric wire to supply power to the panel assembly 60 or transmit a signal for control. Alternatively, the main PCB and the touch screen device 50 may be connected with an electric wire to supply necessary power to the touch screen device 50 or transmit a signal for control.

The decoration lower surface portion 83 may be provided with a cover coupling portion 832 that can be coupled to the decoration cover 90 through a fastening member S2. The cover coupling portion 832 may be formed to protrude upward from the decoration lower surface portion 83. A plurality of electric wire passage holes 831 and a plurality of cover coupling portions 832 may be provided, spaced apart on both sides of the mounting space 84.

The door 20 includes a decoration cover 90 that is coupled to the upper cap decoration 80 to form the upper surface of the door 20. The decoration cover 90 can be coupled to the upper cap decoration 80 while the touch screen device 50 is mounted on the upper cap decoration 80.

The decoration cover 90 includes a cover portion 91 that shields the upper surface of the upper cap decoration 80. In the cover portion 91, a coupling hole 911 through which the fastening member S2 passes may be formed at a position corresponding to the cover coupling portion 832 formed in the upper cap decoration 80.

The decoration cover 90 may include an extension portion 92 extending downward from the cover portion 91. The extension portion 92 may extend to the rear end of the decoration lower surface portion 83 of the upper cap decoration 80.

A plurality of locking portions 921 that are inserted into the locking groove 823 provided in the upper cap decoration 80 may be formed on the extension portion 92. The locking portion 921 is inserted into the locking groove 823, so that the decoration cover 90 can be mounted on the upper cap decoration 80.

The decoration cover 90 may be cut at one side to provide a space 93 in which the hinge device 24 is accommodated.

The touch screen device 50 may be accommodated in the mounting space 84 provided in the upper cap decoration 80. A pressing portion 552 is formed on the touch screen device 50 to enable the touch screen device 50 to be in close contact with the panel assembly 60. In a state where the touch screen device 50 is accommodated in the mounting space 84, the touch screen device 50 may be coupled to the upper cap decoration 80 through a fastening member. The open upper surface of the upper cap decoration 80 can be shielded by the decoration cover 90.

Below, the structure of the touch screen device 50 according to an embodiment of the present disclosure will be described in detail.

Figure 5:
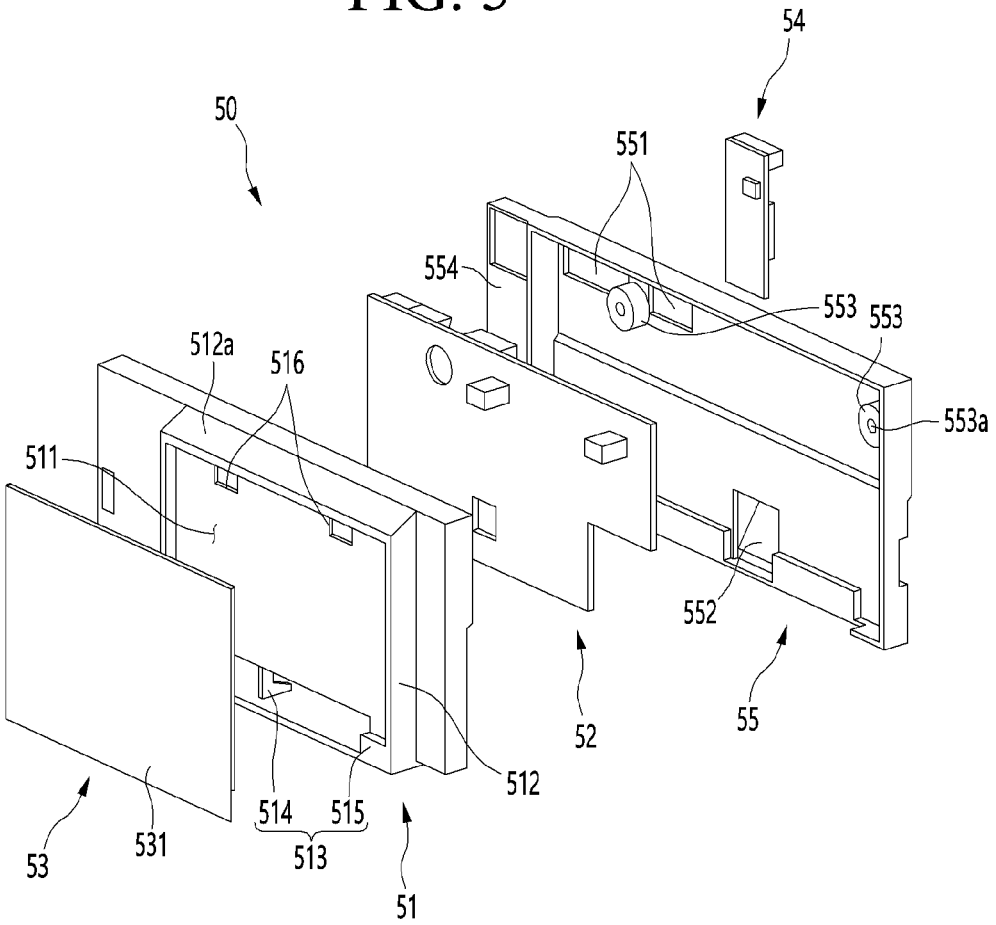
FIG. 5 is an exploded perspective view illustrating a state of a touch screen device according to an embodiment of the present disclosure as viewed from the front.
Figure 6:
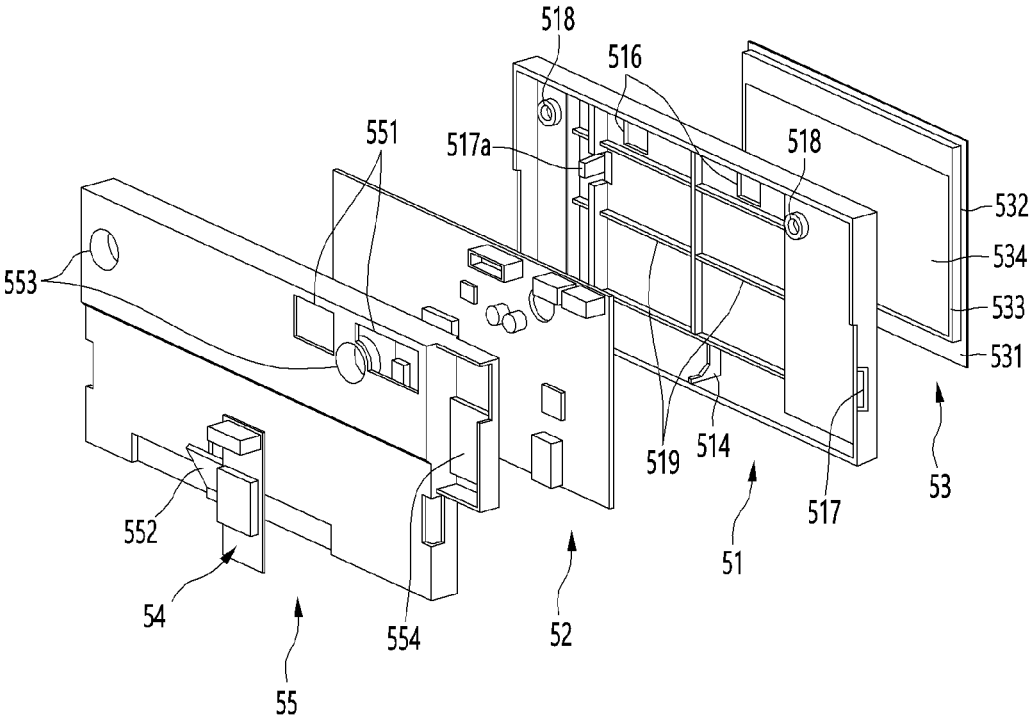
FIG. 6 is an exploded perspective view illustrating a state of a touch screen device according to an embodiment of the present disclosure as viewed from the rear.
Figure 7:
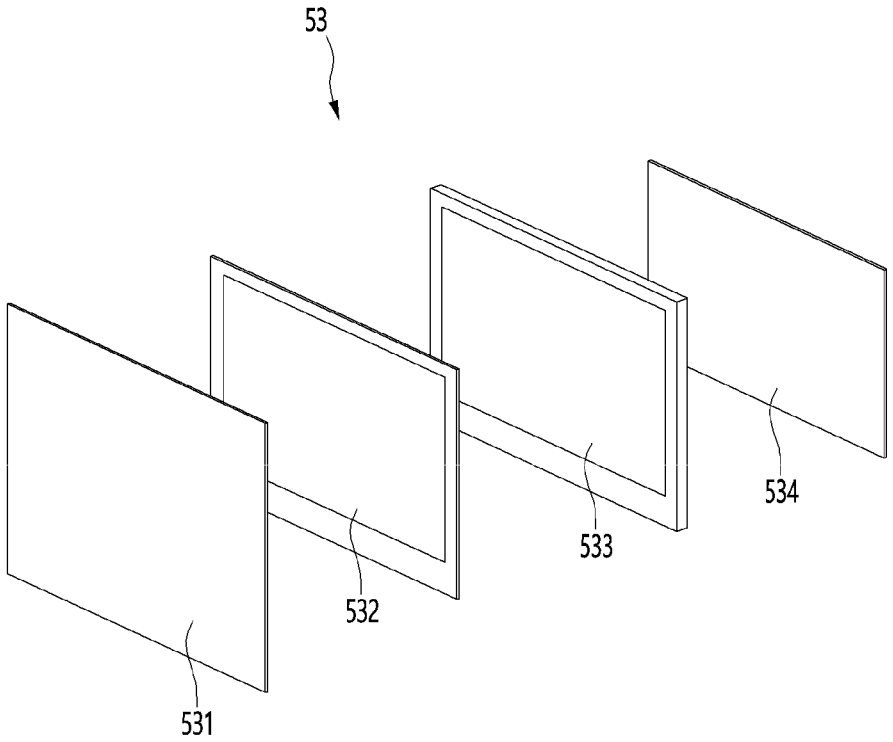
FIG. 7 is an exploded perspective view illustrating a state of a touch module according to an embodiment of the present disclosure as viewed from the front.

FIG. 5 is an exploded perspective view illustrating a state of a touch screen device according to an embodiment of the present disclosure as viewed from the front, FIG. 6 is an exploded perspective view illustrating a state of a touch screen device according to an embodiment of the present disclosure as viewed from the rear, and FIG. 7 is an exploded perspective view illustrating a state of a touch module according to an embodiment of the present disclosure as viewed from the front.

The touch screen device 50 includes a touch module 53 that detects a user's touch operation and outputs a screen. A portion of the front surface of the touch screen device 50 may be formed by the touch module 53.

The touch screen device 50 includes a first case 51 on which the touch module 53 is mounted. The first case 51 includes an accommodation groove 511 in which the touch module 53 is accommodated. The accommodation groove 511 may be formed by recessing from the front surface of the first case 51 to the rear. The accommodation groove 511 may be formed by a circumferential portion 512 protruding from the first case 51 toward the front panel 61.

A fixing portion 513 that fixes the position of the touch module 53 may be formed on the circumferential portion 512. The fixing portion 513 is formed to be in contact with one surface of the touch module 53 in a state where the touch module 53 is accommodated in the accommodation groove 511.

The fixing portion 513 may be in contact with the touch portion 532 of the touch module 53 and the lower end of the display portion 533. The position where the touch module 53 is mounted on the first case 51 can be guided by the fixing portion 513.

A plurality of fixing portions 513 may be formed in the first case 51. For example, the first fixing portion 514 may be formed at the center of the lower end of the circumferential portion 512. In addition, it may further include a pair of second fixing portions 515 formed on both sides of the lower end of the circumferential portion 512. The second fixing portion 515 can support the front end portion of the touch portion 532 of the touch module 53.

An inclined portion 512*a* may be formed in the circumferential portion 512 that slopes downward as it extends in the direction of the front panel 61. The inclined portion 512*a* may be formed on the upper surface of the circumferential portion 512. When the touch screen device 50 is inserted into the upper cap decoration 80, the inclined portion 512*a* may guide the insertion direction. In addition, when water flows into the upper cap decoration 80, the water is guided to move along the inclined portion 512*a*, thereby preventing water from flowing into the touch screen device 50.

The first case 51 may be provided with a plurality of electric wire passage holes 516 through which electric wires pass so that the touch module 53 and the microcomputer 52 can be electrically connected.

The first case 51 may include a coupling hole 518 into which the fastening member S1 that has passed through the boss portion 553 of the second case 55 is coupled.

A microcomputer 52 that controls the touch module 53 may be provided on the rear surface of the first case 51. The first case 51 includes a structure on which the microcomputer 52 can be mounted. For example, the first case 51 may be provided with a locking portion 517*a* that fixes both side ends of the microcomputer 52.

The rear surface of the first case 51 may further include a reinforcing rib 519. The reinforcing rib 519 may reinforce the strength of the first case 51 and at the same time limit the movement of the microcomputer 52.

The microcomputer 52 can control the touch module 53. The microcomputer 52 can receive signals from the wireless communication module 54 and control the screen output from the display portion 533. Additionally, the user's manipulation can be detected through the touch portion 532, and the screen of the display portion 533 can be controlled to be output according to the user's manipulation.

The touch screen device 50 includes a second case 55. The second case 55 forms the rear surface of the touch screen device 50. The second case 55 may be coupled to the first case 51 to form a space for accommodating the microcomputer 52. The second case 55 is configured to cover the open rear surface of the first case 51.

The second case may be provided with an electric wire passage hole 551 that is opened so that the electric wires connected to the microcomputer 52 can be introduced and withdrawn.

The second case 55 includes a pressing portion 552 that presses the touch screen device 50 forward so that it is in close contact with the front panel 61 while the touch screen device 50 is mounted on the upper cap decoration 80.

The pressing portion 552 may be formed in the central portion of the lower end portion 555 of the second case 55. The pressing portion 552 may be formed by cutting a portion of the rear surface of the second case 55 and extending the cutout toward the rear of the second case 55. The pressing portion 552 may extend rearward with one end connected to one surface of the second case 55. The extended end of the pressing portion 552 may be in contact with the upper cap decoration 80.

The pressing portion 552 is made of a material capable of elastic deformation. When the touch screen device 50 is accommodated in the mounting space 84 of the upper cap decoration 80, the pressing portion 552 may be in contact with the rear surface 841 forming the mounting space 84. In a state where the pressing portion 552 is in contact with the rear 841 of the mounting space 84, the pressing portion 552 presses the touch screen device 50 forward so that the touch screen device 50 is in close contact with the front panel 61 by elasticity. Accordingly, the touch screen device 50 can be in uniform close contact with the front panel 61. Therefore, the user's touch operation can be detected reliably.

The second case 55 may be formed with a boss portion 553 through which the fastening member S1 passes. A plurality of boss portions 553 may be provided at the upper end portion of the first case 51. A boss hole 553*a* may be formed with the boss portion 553 to allow the fastening member S1 to pass through. The fastening member S1 that passes through the boss portion 553 may be fastened to the coupling hole 518 formed in the first case 51. Accordingly, the first case 51 and the second case 55 may be coupled to each other. In addition, when the touch screen device 50 is mounted in the mounting space 84, while the fastening member S1 passes through the boss portion 553, the touch screen device 50 may be pressed to be in close contact with the front panel 61. Accordingly, the touch screen device 50 can form a sense of unity with the front panel 61 on the front surface of the door 20 without a step. Additionally, the user's touch operation can be detected reliably.

A wireless communication mounting portion 554 may be formed on one side of the second case 55 to allow the wireless communication module 54 to be mounted. The wireless communication mounting portion 554 may be formed extending from one side of the second case 55. Accordingly, the space where the microcomputer 52 is mounted and the wireless communication mounting portion 554 can be provided to be spaced apart from each other.

The wireless communication mounting portion 554 is provided with a wireless communication module 54 capable of receiving signals from the user's remote device 100. For example, this wireless communication module 54 may be composed of a Wi-Fi or Bluetooth module. The wireless communication module 54 can receive signals sent from the user's remote device 100, such as a mobile phone or tablet, and transmit them to the microcomputer 52. The microcomputer 52 can control the screen output from the touch screen device 50 according to the signal received from the wireless communication module 54.

Meanwhile, the touch module 53 includes a touch portion 532 that detects the user's touch operation and a display portion 533 that outputs a screen. The touch module 53 can detect the user's touch operation and output a screen set to the touch screen device 50.

The touch portion 532 may be configured to detect a touch operation of the front panel 61. This touch portion 532 may be provided using a film or sheet adhesive method. A glass portion 531 may be disposed on the front surface of the touch portion 532. The touch portion 532 may be formed to have a size corresponding to or smaller than that of the glass portion 531.

The glass portion 531 may be provided between the touch portion 532 and the front panel 61. The glass portion 531 is provided to maintain the flatness of the front surface of the touch module 53 when the touch portion 532 is brought into close contact with the front panel 61 by the pressing portion 552.

The glass portion 531 may be provided in the form of a sheet or film made of glass. The glass portion 531 is in close contact with the front panel 61, so that the touch module 53 and the front panel 61 can be formed in a more integrated manner on the front of the refrigerator.

The display portion 533 may be composed of an LCD module that outputs a screen. The display portion 533 may be electrically connected to the microcomputer 52. The display portion 533 can output a screen according to the signal received from the microcomputer 52. The display portion 533 may be disposed on the rear surface of the touch portion 532. The touch portion 532 and the display portion 533 may be formed in sizes corresponding to each other.

The touch module 53 further includes a glass portion 531 that covers the entire area of the touch portion 532. The glass portion 531 may be disposed on the front surface of the touch portion 532 to form the outer appearance of the front surface of the touch module 53.

The glass portion 531 may be formed to be larger than the size of the touch portion 532. The glass portion 531 may extend longer so that the lower end of the glass portion is positioned further below the lower end of the touch portion 532.

The glass portion 531 may extend to cover the fixing portion 513 from the front. In other words, when the touch module 53 is mounted on the first case 51, the lower end of the touch portion 532 and the display portion 533 are located at the upper end of the fixing portion 513, and the glass portion 531 may extend further to the lower end of the first case 51. In this case, the first case 51 may press the glass portion 531 from the rear to the front. Accordingly, the glass portion 531 can be maintained in closer contact with the front panel 61, thereby improving the flatness of the touch module 53.

The touch module 53 includes an adhesive portion 534 configured to mount the touch module 53 to the first case 51. The adhesive portion 534 may be provided in the form of a film or sheet containing adhesive. This adhesive portion 534 may be disposed on the rear surface of the display portion 533.

Figure 8:
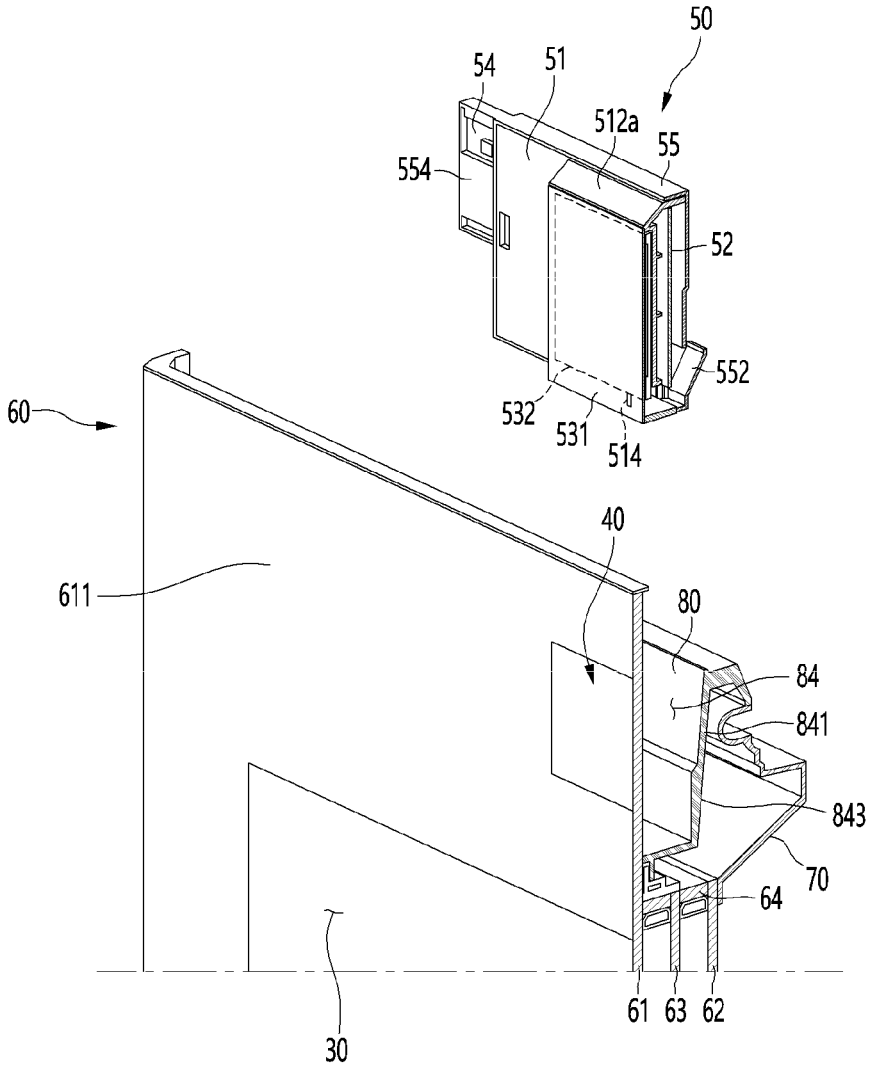
FIG. 8 is a cross-sectional view for explaining the coupled structure of the touch screen device and the door.
Figure 9:
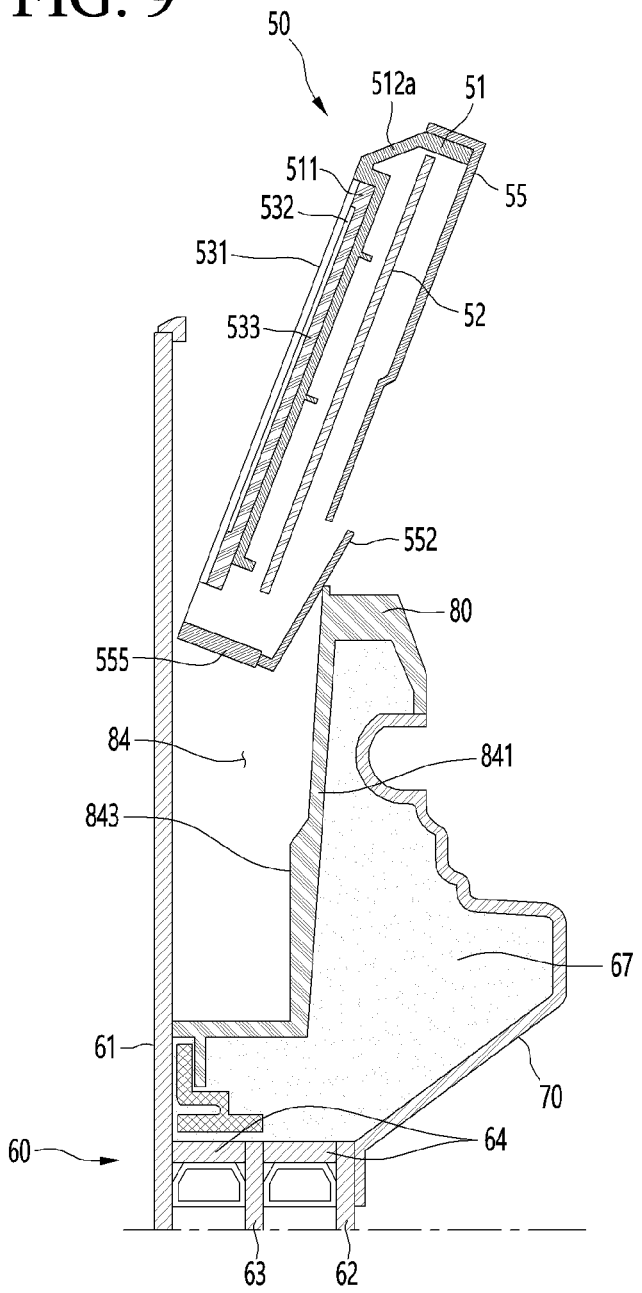
FIG. 9 is a cross-sectional view to explain the process of inserting the touch screen device into the door.
Figure 10:
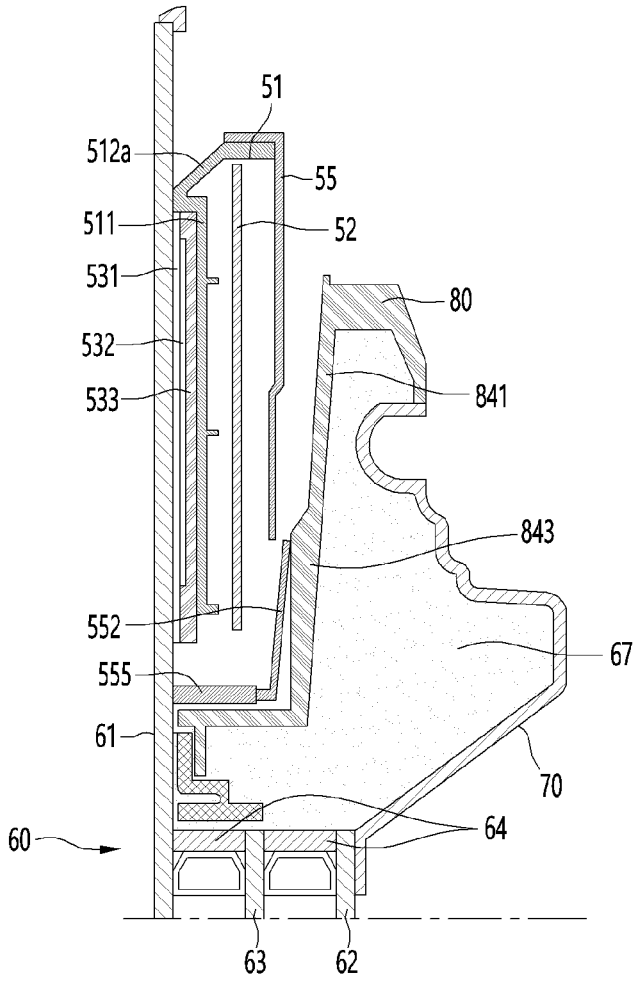
FIG. 10 is a cross-sectional view illustrating a state where the touch screen device is mounted on the door.
Figure 11:
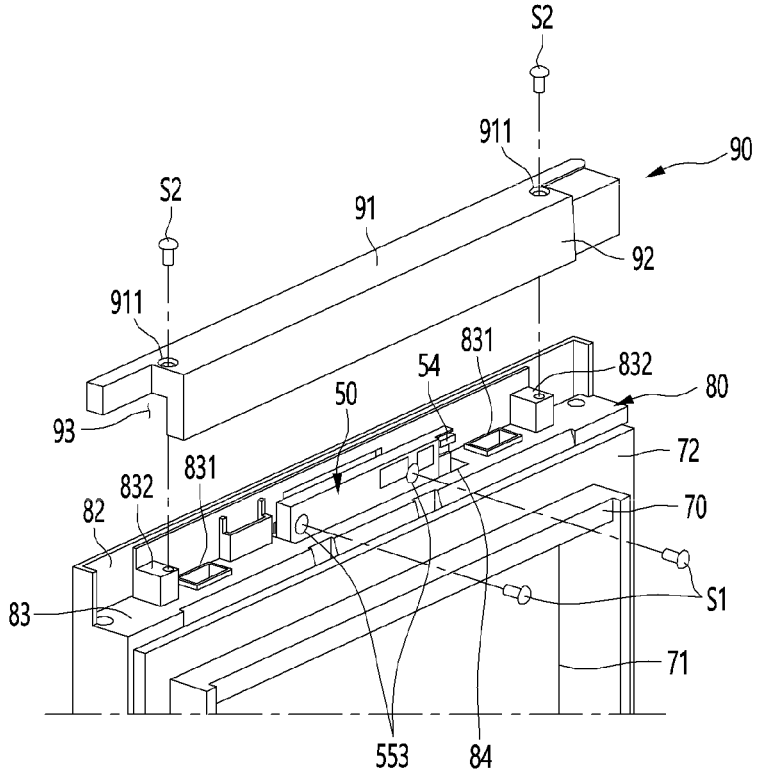
FIG. 11 is a view for explaining the process of assembling the touch screen device to the door.

FIG. 8 is a cross-sectional view for explaining the coupled structure of the touch screen device and the door, FIG. 9 is a cross-sectional view to explain the process of inserting the touch screen device into the door, FIG. 10 is a cross-sectional view illustrating a state where the touch screen device is mounted on the door, and FIG. 11 is a view for explaining the process of assembling the touch screen device to the door.

The touch screen device 50 can be inserted into the mounting space 84 provided in the upper cap decoration 80 in a sliding manner while the decoration cover 90 of the door 20 is separated.

The inclined portion 512*a* is formed to slope downward from the upper end of the front surface of the touch screen device 50 toward the front panel 61. The touch module 53 may be disposed connected to the lower end of the inclined portion 512*a*.

The pressing portion 552 may be inclined upward from the lower end of the rear surface of the touch screen device 50 to approach the rear surface 841 of the mounting space 84.

The inclined portion 512*a* and the pressing portion 552 may guide the direction in which the touch screen device 50 is inserted into the upper cap decoration 80.

When the touch screen device 50 is inserted into the upper cap decoration 80 mounting space 84, the touch screen device 50 can be in contact with the upper cap decoration 80 in an inclined state from the upper side of the door 20. In detail, when the touch screen device 50 is initially inserted into the mounting space 84, the pressing portion 552 is in contact with the rear surface 841 of the mounting space 84, and the lower end of the front surface of the touch screen device 50 is in a state of being in contact with the front surface 842 of the mounting space 84.

The end of the pressing portion 552 is in contact with the rear surface 841 and slides. At this time, a guide portion 843 that guides the pressing portion 552 may be formed on the rear surface 841 of the mounting space 84. The guide portion 843 may be formed at a position corresponding to the position where the pressing portion 552 is mounted on the rear surface 841. A pair of guide portions 843 may be formed along the rear surface 841 so as to contact both side ends of the pressing portion 552.

When the touch screen device 50 is mounted on the upper cap decoration 80, the pressing portion 552 can press the touch screen device 50 toward the front panel 61. Accordingly, the touch module 53 provided on the front surface of the touch screen device 50 can be in close contact with the front panel 61.

The rear portion of the mounting space 841 may be inclined to approach the front panel as it moves downward from the upper end. In this case, the pressing portion 552 can press the touch screen device 50 more strongly in the direction of the front panel 61.

In a state where the touch screen device 50 is inserted into the mounting space 84, the fastening member S1 penetrates the boss portion 553 to couple the first case 51 and the second case 55. Additionally, the fastening member S1 that penetrates the boss portion 553 may be fastened to the coupling portion 822 formed on the decoration front surface portion 82. In other words, the fastening member S1 passing through the touch screen device 50 is coupled to the coupling portion 822 formed on the decoration front portion 82. In this process, the fastening member S2 presses the touch screen device 50 forward. Accordingly, the touch screen device 50 can be fixed in close contact with the front panel 61.

In a state where the touch screen device 50 is mounted on the upper cap decoration 80, the decoration cover 90 may be coupled to the upper cap decoration 80. In detail, the fastening member S2 passing through the coupling hole 911 formed in the decoration cover 90 may be coupled to the cover coupling portion 832 formed in the decoration lower surface portion 83. When the decoration cover 90 is mounted on the upper cap decoration 80, the decoration cover 90 can be connected to the upper end of the front panel 61.

Meanwhile, the touch screen device 50 can be replaced from the door 20 as needed. In this case, after separating the decoration cover 90 from the upper cap decoration 80, the fastening member S1 fastened to the boss portion 553 is separated, and thus the touch screen device 50 can be easily separated from the upper cap decoration 80.

Figure 12:
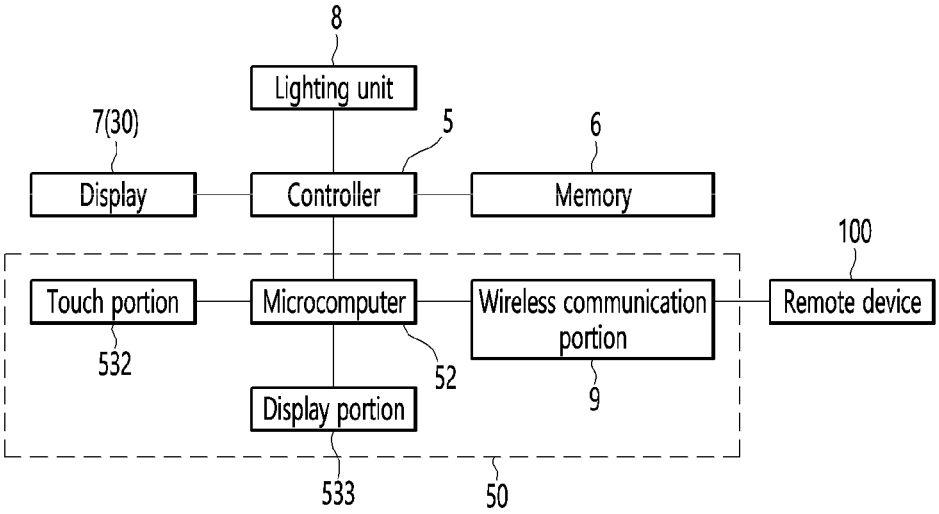
FIG. 12 is a block diagram illustrating the refrigerator according to this embodiment.
Figure 13:
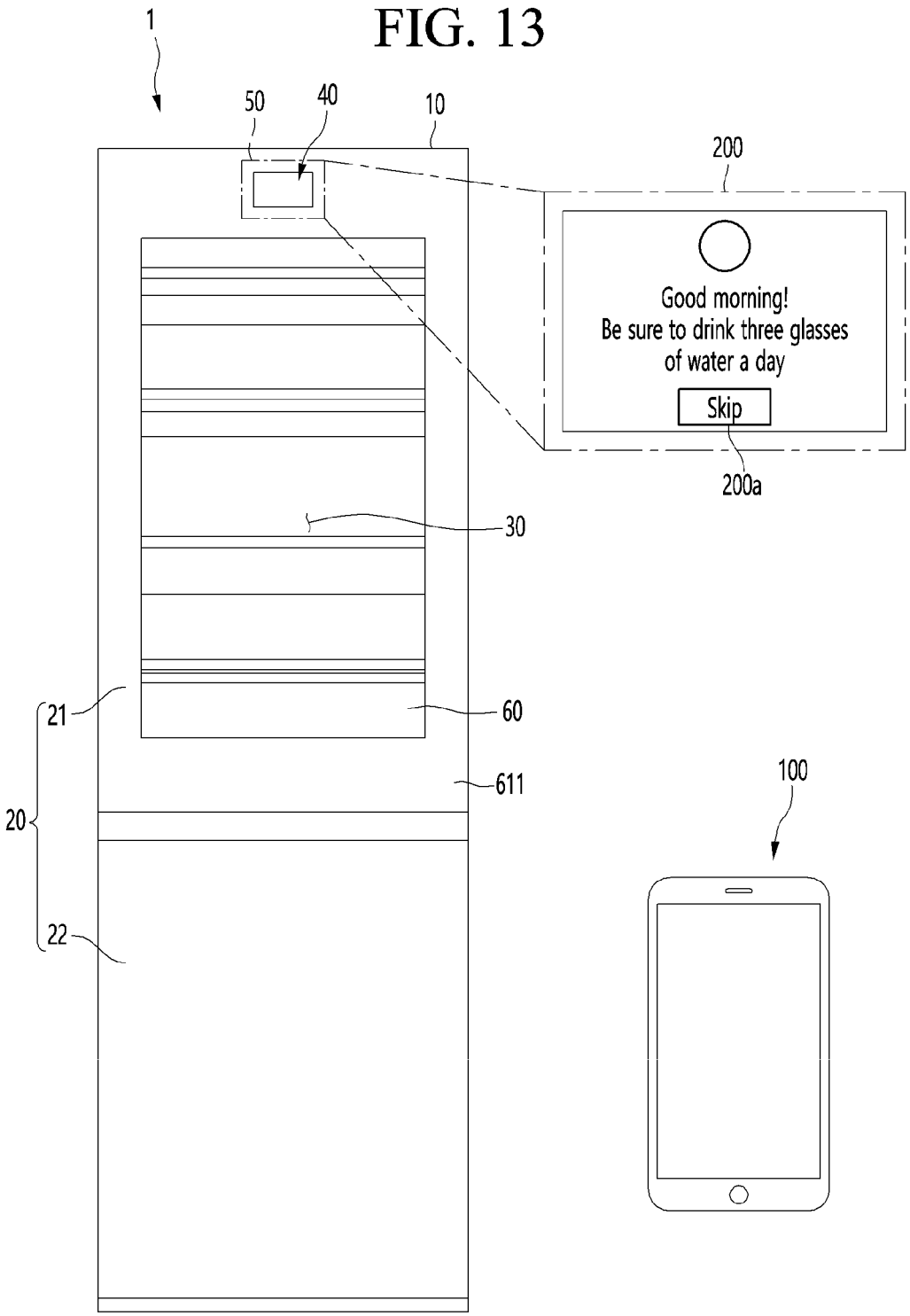
FIG. 13 is a view to explain the operating state of the touch screen device.

FIG. 12 is a block diagram illustrating the refrigerator according to this embodiment, and FIG. 13 is a view to explain the operating state of the touch screen device.

The refrigerator 1 of this embodiment may include a controller 5. The controller 5 may control the overall operation of the refrigerator 1 or the operation of some of the components constituting the refrigerator 1.

The refrigerator 1 may further include a memory 6. The memory 6 may store a screen or image on which the see-through portion 30 and the display portion 40 are output.

The refrigerator 1 may further include a display 7. The display 7 is provided on the panel assembly 60 and can output a screen captured within the refrigerator through the see-through portion 30 or a set screen.

The refrigerator 1 may further include a lighting unit 8 provided on the door 20. Upon receiving a user's touch operation applied to the panel assembly 60, the lighting unit 8 may be turned on.

The refrigerator 1 may further include a touch screen device 50. When the microcomputer 52 provided in the touch screen device 50 receives a user's touch operation from the touch module 53, the microcomputer can output a screen set on the display portion 533 according to the user's command.

Additionally, the refrigerator 1 may further include a wireless communication portion 9. The wireless communication portion 9 may be a wireless communication module provided in the touch screen device 50.

The wireless communication portion 9 is connected to the user's remote device and can receive signals from the remote device. The wireless communication portion 9 can transmit signals from a remote device to the microcomputer 52. The microcomputer 52 can control the display portion 533 of the touch screen device 50 according to signals from the remote device.

For example, a user can set an alarm output from the display portion 533 through a remote device. This alarm can be output to the display portion 533 with a set phrase at a set time. Then, the user can check the alarm by touching it through the display portion 40. Additionally, the user can check the alarm to be displayed next by touching the display portion 40.

At this time, the display portion 40 is capable of receiving touch signals in the entire area by the touch screen device 50. This can also be called a full-touch screen method. In other words, rather than operating by touching a button that appears in a set area of the display portion 40, the entire area of the display portion 40 can be touched and thus operated.

Accordingly, the user can check the simple notification 200 through the display portion 40 and dismantle the notification status by touching a partial area 200*a* of the entire area of the display portion 40. Additionally, the user can simply manipulate the refrigerator operation settings through the display portion 40 provided on the front surface of the door without opening the door.

Figure 14:
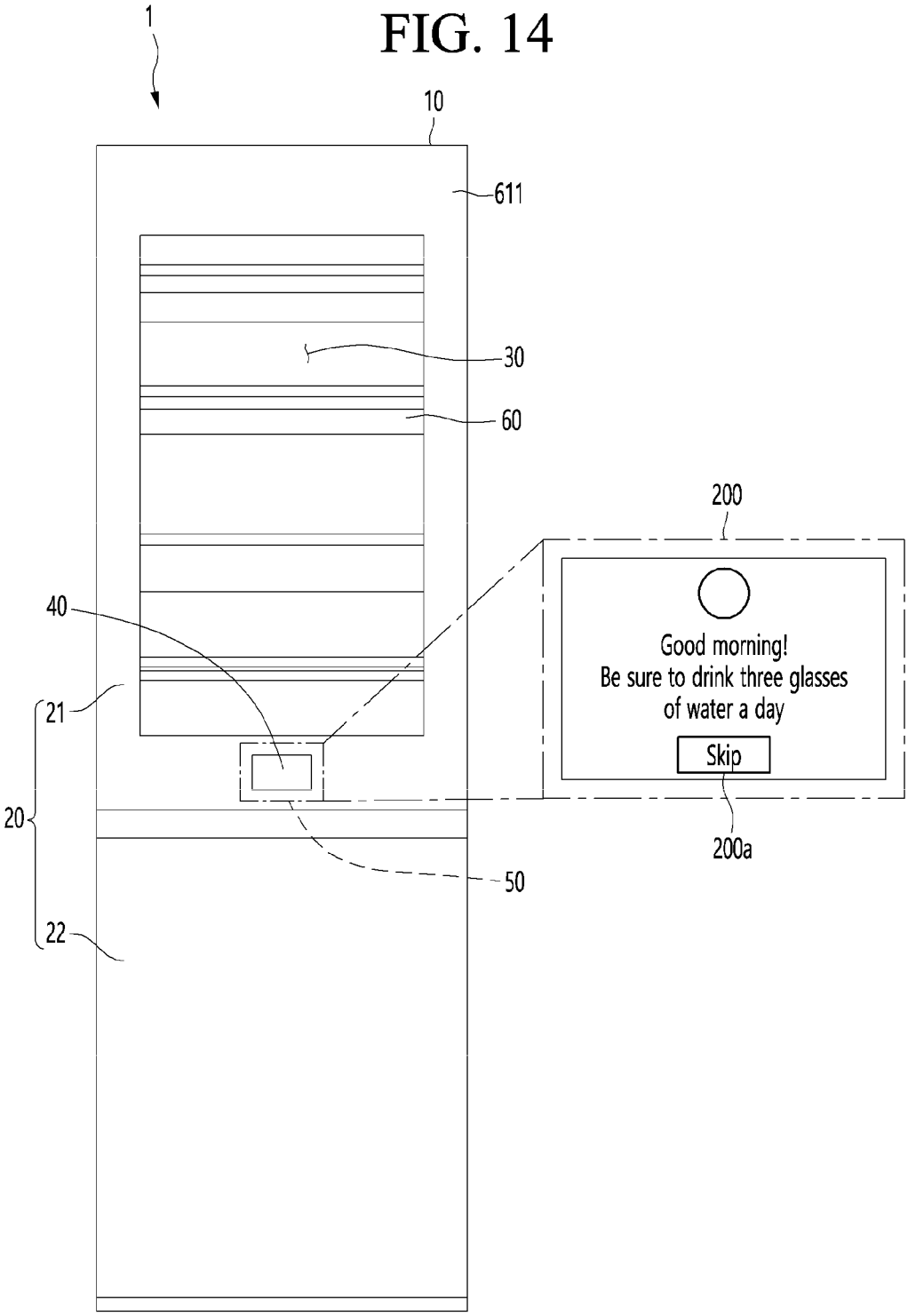
FIG. 14 is a front view illustrating a refrigerator according to another embodiment of the present disclosure.

FIG. 14 is a front view illustrating a refrigerator according to another embodiment of the present disclosure.

The refrigerator 1' according to an embodiment of the present disclosure has been described as an example in which the touch screen device 50 is provided at the upper end portion of the door 20, but the present disclosure is not limited thereto.

For example, the touch screen device 50 may be provided at the lower end portion of the door 20. In a refrigerator according to another embodiment of the present disclosure, the display portion 40 may be formed to be spaced downward from the see-through portion 30. In this case, the touch screen device 50 may be provided in the lower cap decoration 65. In detail, a mounting space into which the touch screen device 50 is inserted may be provided by being recessed in the lower cap decoration 65.

The touch screen device 50 can use the structure of the touch screen device 50 described above as it is. The touch screen device 50 may be mounted on the lower cap decoration 65 on the lower side of the door 20.

The touch screen device 50 is provided at the lower end of the upper door 21, so that even a small child can easily operate the touch screen.

Although the present disclosure is described using a refrigerator as an example, the features of the present disclosure can also be applied to home appliances that have a cabinet that forms a storage space and a door that opens and closes the cabinet.

For example, the home appliance may be any one of an air conditioner, a dishwasher, a clothes care machine, a washing machine, or a cooking appliance, each of which may have a structure in which the touch screen device 50 of an embodiment of the present disclosure is provided on the door 20.

What is claimed is:

1. A refrigerator comprising:

a cabinet that defines a storage space; and a door configured to open and close at least a portion of the storage space, the door comprising (i) a see-through portion configured to allow viewing of the storage space and (ii) a bezel portion disposed around the see-through portion, wherein the door comprises:

a panel assembly comprising a plurality of glass panels that include a front panel, the front panel defining an outer appearance of a front surface of the door, a touch screen that is disposed at the bezel portion and configured to detect a touch operation of a user and to output screen information based on the touch operation, and a door frame disposed at the bezel portion and connected to the panel assembly, the door frame comprising an upper cap decoration in contact with a rear surface of the front panel, and wherein the touch screen is disposed at the upper cap decoration and comprises a pressing portion that is configured to press the door frame to provide force to the touch screen toward the front panel to thereby bring the touch screen into contact with the front panel.

2. The refrigerator of claim 1, wherein the front panel comprises:

a first portion that faces the touch screen and is configured to transmit light; and a second portion configured to limit transmission of the light, and wherein the upper cap decoration comprises:

a decoration front surface portion that is in contact with the front panel and defines a cutout at a position corresponding to the first portion, and a decoration lower surface portion that is recessed downward and defines a mounting space accommodating the touch screen.

3. The refrigerator of claim 2, wherein the upper cap decoration further comprises a rear wall that faces the mounting space from a rear side of the mounting space, and wherein the pressing portion is configured to be in contact with the rear wall based on the touch screen being accommodated in the mounting space.

4. The refrigerator of claim 3, wherein the touch screen comprises:

a first case;

a touch module disposed at the first case;

a microcomputer configured to control the touch module; and a second case coupled to the first case to thereby define a space accommodating the microcomputer between the first case and the second case.

5. The refrigerator of claim 4, wherein the pressing portion has (i) a first end connected to a first side of the second case and (ii) a second end that extends rearward relative to the first end and is configured to be in contact with the rear wall.

6. The refrigerator of claim 5, wherein the upper cap decoration further comprises a guide portion that protrudes from the rear wall toward the front panel and faces the pressing portion.

7. The refrigerator of claim 4, further comprising a fastening member that couples the touch screen to the decoration front surface portion, wherein the touch screen comprises a boss portion that receives the fastening member, and wherein the decoration front surface portion defines a coupling portion that receives the fastening member through the boss portion.

8. The refrigerator of claim 4, wherein the first case defines an accommodation groove that is recessed rearward away from the front panel and accommodates the touch module, wherein the first case comprises a circumferential portion that is disposed along the accommodation groove and protrudes in a forward direction toward the front panel, and wherein the circumferential portion comprises an inclined portion that is inclined with respect to the forward direction.

9. The refrigerator of claim 4, wherein the touch module comprises:

a touch portion configured to detect the touch operation;

a glass portion disposed at a front side of the touch portion and in contact with the front panel; and a display portion configured to output the screen information, and wherein a size of the glass portion is greater than a size of each of the touch portion and the display portion.

10. The refrigerator of claim 9, wherein the first case defines an accommodation groove that accommodates the touch module, and wherein the first case comprises:

a circumferential portion that is disposed along the accommodation groove and protrudes in a forward direction toward the front panel, and a fixing portion that is disposed at the circumferential portion and supports the touch portion and the display portion.

11. The refrigerator of claim 9, wherein the touch screen comprises a wireless communication module configured to communicate with a remote device.

12. The refrigerator of claim 11, wherein the second case defines a wireless communication mounting portion that accommodates the wireless communication module at one side of the second case.

13. The refrigerator of claim 11, wherein the microcomputer is configured to control the display portion to output the screen information based on a signal received from the remote device.

14. The refrigerator of claim 2, further comprising:

a decoration cover that covers an upper surface of the upper cap decoration, wherein the decoration cover is detachably coupled to the upper cap decoration in a state in which the touch screen is accommodated in the mounting space.

15. The refrigerator of claim 14, further comprising a fastening member that couples the decoration cover to the upper cap decoration, wherein the decoration cover defines a coupling hole that receives the fastening member, and wherein the upper cap decoration comprises a cover coupling portion that protrudes upward from the decoration lower surface portion and receives the fastening member through the coupling hole.

16. The refrigerator of claim 3, wherein the pressing portion protrudes rearward from a rear surface of the touch screen and is configured to apply force to the touch screen toward the front panel based on the pressing portion contacting the rear wall.

17. The refrigerator of claim 16, wherein the rear surface of the touch screen is spaced apart from the rear wall, and the pressing portion is inclined with respect to the rear surface of the touch screen.

18. The refrigerator of claim 3, wherein the front panel extends in a vertical direction, and the rear wall is inclined rearward with respect to the vertical direction.

19. The refrigerator of claim 18, wherein the rear wall is spaced apart from a rear surface of the touch screen and configured to contact the pressing portion, and wherein the pressing portion protrudes rearward from the rear surface of the touch screen and is inclined toward the rear wall with respect to the vertical direction, the pressing portion being configured to apply force to the touch screen toward the front panel based on the pressing portion contacting the rear wall.

* * * * *